United States Patent [19]

Alvarado

[11] Patent Number: 4,501,425

[45] Date of Patent: Feb. 26, 1985

[54] BUSINESS ORGANIZATION GAME

[75] Inventor: Daniel D. Alvarado, Phoenix, Ariz.

[73] Assignee: Robert J. Alvarado, San Jose, Calif.

[21] Appl. No.: 400,460

[22] Filed: Jul. 21, 1982

[51] Int. Cl.[3] ..... H63F 3/00

[52] U.S. Cl. ..... 273/256; 273/249

[58] Field of Search ..... 273/256, 249, 248

[56] References Cited

U.S. PATENT DOCUMENTS

| | | | |
|---|---|---|---|
| 2,666,644 | 1/1954 | Strehlow et al. | 273/256 |
| 3,058,747 | 10/1962 | Nemetsky et al. | 273/256 |
| 4,046,381 | 9/1977 | Comeaux | 273/249 |
| 4,162,075 | 7/1979 | Iannucci | 273/256 |
| 4,354,684 | 10/1982 | McKinley | 273/256 |
| 4,360,205 | 11/1982 | Rimbold | 273/256 |

FOREIGN PATENT DOCUMENTS

| | | | |
|---|---|---|---|
| 2310782 | 12/1976 | France | 273/256 |

*Primary Examiner*—Richard C. Pinkham
*Assistant Examiner*—Scott L. Brown
*Attorney, Agent, or Firm*—Cahill, Sutton & Thomas

[57] ABSTRACT

A game having the object of winning either by promotion to the chairman of the board or by acquisition of a majority interest in stock of a corporation is based upon real life corporate decision making requirements with commensurate rewards and penalties. A two part game board is laid out to depict two paths; the first path reflects the position of each player upon the corporate ladder and the second path regulates a player's financial status and extent of stock ownership. The second path is divided into a plurality of sections, each section being directed to one of six discrete corporate functions and each of which functions affects by stipulated extent or by trading option possibilities of a player's progress in both areas of interest. An element of luck is introduced by directing to some extent a player's movement along the second path by the throw of a pair of dice.

7 Claims, 9 Drawing Figures

BUSINESS ORGANIZATION GAME

The present invention relates to games and, more particularly, to a game simulative of success within a corporate environment.

Games, from time in memorial, have been played by children and adults. The most popular games have been those in which the outcome has been based upon a combination of the player's skill and luck. If one or the other predominates, the universal appeal of the game is diminished. Similarly, games in which the mode of play is directed along a single concept, the satisfaction derived from the game is less than otherwise possible.

It is therefore a primary object of the present invention to provide a game having discrete and sometimes conflicting modes of play.

Another object of the present invention is to provide a game within which skill in decision making plays an important role.

Yet another object of the present invention is to provide a game having an element of luck interspersed with a requirement for business acumen.

Yet another object of the present invention is to provide a game catering to the urge to accumulate wealth through clever negotiation.

A further object of the present invention is to provide a game within which decisions between prestige and wealth must be made.

A still further object of the present invention is to provide a game simulative of the vagaries of advancement within a corporate structure.

A yet further object of the present invention is to provide a game continually offering an opportunity to alter the outcome irrespective of past success.

These and other objects of the present invention will become apparent to those skilled in the art as the description thereof proceeds.

The present invention may be described with greater specificity and clarity with reference to the following figures, in which.

Figure 1:
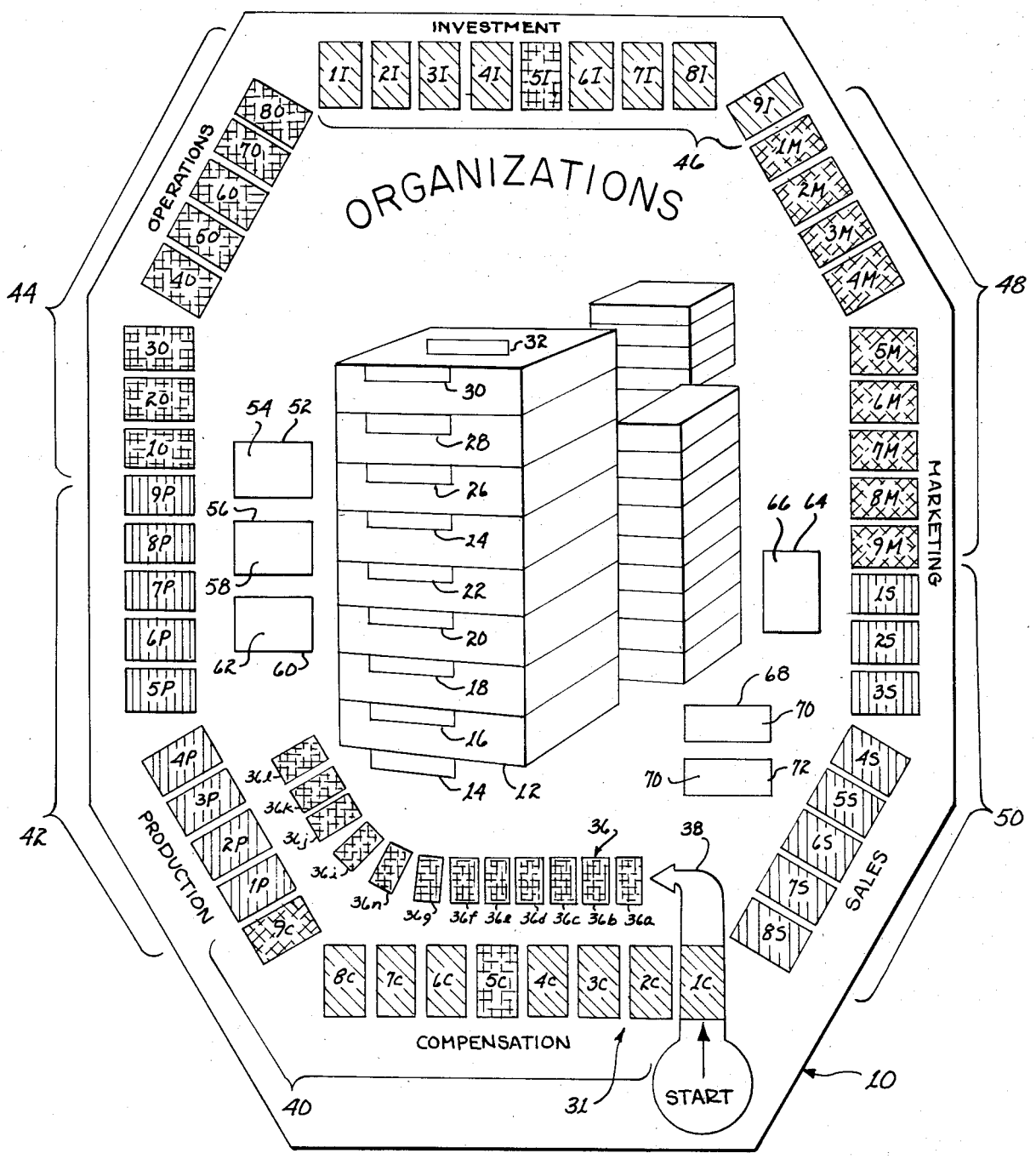
FIG. 1 illustrates a representation of a playing board.
Figure 8:
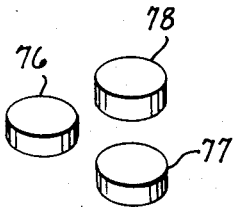
FIG. 8 depicts playing pieces and a token.
Figure 9:
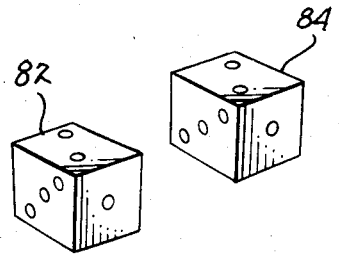
FIG. 9 depicts a pair of dice used to play the game.

Referring to FIG. 1, there is shown a game board 10 having octagonal sides, the peripheral configuration of which is optional. Central to the game board is depicted a first path 12, which path is synonymous with a corporate ladder. The corporate ladder may include positions of mail clerk 14, group leader 16, supervisor 18, manager 20, corporate officer 22 assistant vice-president 24, vice-president 26, executive vice-president 28, president 30 to the position of chairman of the board 32. For illustrative purposes, the corporate ladder is pictorialized as a skyscraper adjacent other skyscrapers. A second path 14, identified by reference numeral 34 is a continuous path extending around the board encircling the first path 12. A supplementary path identified as bonus lane 36 is interconnected with first path 34 by arrow 38. The bonus lane includes twelve spaces with the following legends: blank 36*a;* buy stock (up to 10 shares) 36*b;* buy stock (up to 5 shares) 36*c;* $50,000.00 36*d;* $25,000.00 36*e;* $10,000.00 36*f;* $5,000.00 36*g;* $10,000.00 36*h;* $25,000.00 36*i;* $50,000.00 36*j;* promotion (1 rung) 36*k;* and promotion (2 rungs) 36*l.*

Second path 34 is divided into a plurality of sections, each of which sections may be color coded as depicted. Section 40 is a section identified as the compensation section. A second section 42 is labeled the production section. A third section 44 is labeled the operations section. A fourth section 46 is labeled the investment section. A fifth section 48 is labeled the marketing section. A sixth section 50 is labeled the sales section.

Figure 4:
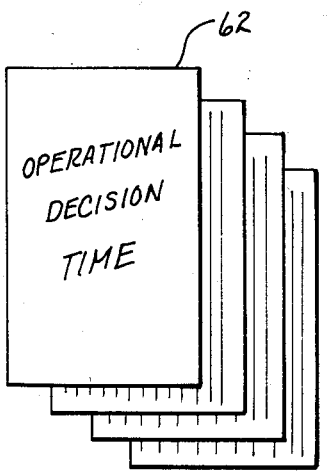
FIG. 4 depicts a stack of decision evaluation cards.
Figure 3:
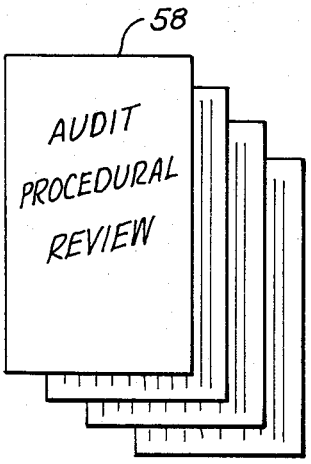
FIG. 3 depicts a stack of audit review cards.
Figure 2:
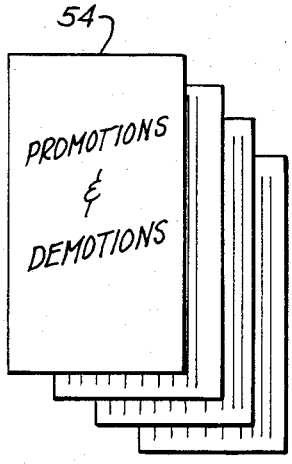
FIG. 2 depicts a stack of promotion and demotion control cards.
Figure 5:
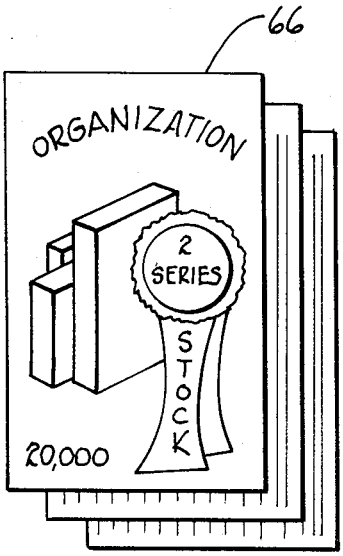
FIG. 5 depicts a stack of stock certificates.
Figure 7:
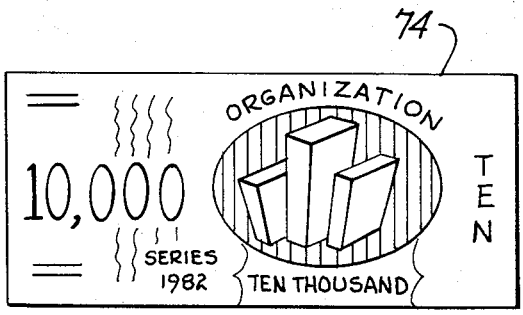
FIGS. 6 and 7 depict stacks of different denomination paper money.
Figure 6:
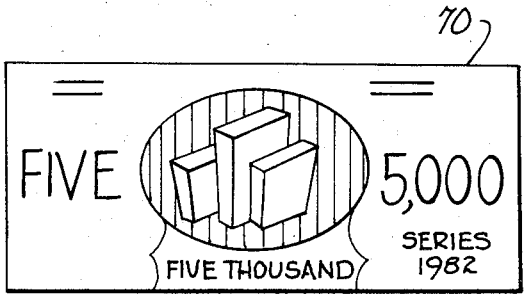

Location 52 reflects the location of the stack of promotion and demotion cards 54, depicted in FIG. 2. Location 56 reflects the location of the stack of audit review cards 58, depicted in FIG. 3. Location 60 depicts the location of the stack of decision evaluation cards 62, depicted in FIG. 4. Location 64 depicts the stack of certificates of stock 66, illustrated in FIG. 5. Location 68 depicts the location for a stack of bills 70, depicted in FIG. 6. Location 72 depicts the location of a stack of bills 74, depicted in FIG. 7. It is to be understood that the depository for the certificates of stock and bills are illustrated on game board 10 as a matter of convenience.

Compensation section 40 includes nine squares. Each of these squares, enumerated 1*c* to 9*c,* delineates certain compensation related instructions. More specifically, the instructions delineated on each position follows:

1*c*—Company Bonus! Move to "START" and throw for a bonus.

2*c*—Compensation division manager's office. Outstanding job! You have been promoted to the next level of management. Collect $10,000.00.

3*c*—Job description reevaluation committee. If on the 1st rung, move to the 2nd rung. If on the 3rd rung, move the the 4th rung.

4*c*—Income tax specialist. Pay or collect $5,000.00 for each rung you have advanced. If you throw an odd number, you pay, but if you throw an even number, you collect.

5*c*—Draw a decision card.

6*c*—Yearly performance review. Good effort! Receive $20,000.00.

7*c*—Yearly performance review. Very good effort! Receive $25,000.00

8*c*—Budget control specialist. Your company credit card is over limit. Throw an "8" to continue the game. You have 2 throws at each turn.

9*c*—Draw audit review card.

Production section 42 includes nine squares, each of which are identified by one or numerals 1*p* to 9*p.* Each square includes certain instructions relating to an increase or decrease in production expertise with commensurate rewards and penalties associated therewith. Specifically, squares 1*p* to 9*p* contain the following instructions:

1*p*—Operations planning committee. Collect the $20,000.00 you planned for from the previous year.

2*p*—Production deadline committee. Outstanding! You met deadlines 100 percent. Bonus! Throw a "7" for a promotion and collect $10,000.00. 2 throws.

3*p*—Production division manager's office. Excellent job! Promotion! Collect $25,000.00.

4*p*—Research and adjustments. Budget addition error and you pay $10,000.00 to make adjustments.

5*p*—Production deadline committee. Critical deadlines less than 50 percent throw a "7" or "Double" and you get a demotion and a $15,000.00 penalty. 2 throws.

6*p*—Draw promotion/demotion card.

7*p*—Quality control circles. You devised a solution to a major company problem. Move one rung up the ladder. Collect $15,000.00.

8*p*—Suspense area. You are out of balance and you have to be placed under suspension. Skip a turn. Pay $10,000.00

9*p*—Records area. Collect $10,000.00 for organizational growth.

Operations section 44 includes eight squares referenced 1*o* to 8*o*. The instructions attendant each square relate to operations related success or failure with commensurate rewards to penalties. Specifically, the instructions attendant each square are as follows:

1*o*—Transit area. Throw a "Double" and go to bonus square or throw a "7" and go to decision square to the right.

2*o*—Funds flow area. Give the player to the right $10,000.00, but if you throw a "7", the player pays you. 2 throws.

3*o*—Quality control area. Poor system? Throw an even number and there is no penalty but if you throw an odd number, you pay $15,000.00 for a quality consultant.

4*o*—Data input area. Feed an even number into the system and collect $15,000.00 or feed an odd number into the system and pay $15,000.00. 1 throw.

5*o*—Operations planning committee. The $10,000.00 you planned—rejected. Return the amount.

6*o*—System breakdown. Go to the nearest audit review square to the right.

7*o*—Computer division manager's office. You are not doing too hot! Demotion! Forfeit $15,000.00.

8*o*—Production Scheduler's office. Major scheduling error! Pay $10,000.00 to correct. Throw an even number for no penalty. One throw.

Investment section 46 includes nine squares identified 1*i* to 9*i*. Each of these squares reflect good or bad investment decisions with commensurate rewards or penalties stipulated. Specifically, squares 1*i* to 9*i* include the following statements:

1*i*—Investment division manager's office. Fine job! Promotion time! Collect $15,000.00

2*i*—Security and settlement's office. The company pays you $50,000.00 as a business settlement.

3*i*—Collection settlement's office. Pay this office an outstanding debit of $30,000.00. If you throw a "7" there is no penalty. 2 throws.

4*i*—Stock option. You may buy up to five certificates at $20,000.00 each.

5*i*—Draw decision card.

6*i*—Shareholder and investment office. As a reward for your present progress, you now own two certificates of stock.

7*i*—Trading and evaluations office. Trade with any player you choose or throw a "Double" for $30,000.00. 2 throws.

8*i*—Investments review committee. Excellent effort! Promotion, if you throw a "10". 2 throws.

9*i*—Stock option. You may buy up to five certificates of stock at $20,000.00 per certificate.

Marketing section 48 includes nine squares identified 1*m* to 9*m*, each of which recites marketing successes or failures with commensurate rewards and penalties. Specifically, the recitations for each square are as follows:

1*m*—You indulged in the spirits while at a convention. Skip a turn while you recuperate.

2*m*—Advertising department. Your logo slogan was excellent! Bonus! Collect $10,000.00.

3*m*—Marketing review committee. Throw a "6" and you get a promotion but throw an "8" and you get a demotion.

4*m*—Systems department. You purchased a faulty computer. Pay $10,000.00 to fix.

5*m*—Take a company trip with the boss. Move directly to the special bonus square.

6*m*—Sales incentives committee. If you throw a "Double" you receive $40,000.00. 2 throws.

7*m*—Merchandizing committee. Your year's quota is down. You have a chance to make it up by throwing a "5" or pay $15,000.00. 2 throws.

8*m*—Draw audit review card.

9*m*—Business development office. Collect $5,000.00 from each player for your organizational growth.

Sales section 50 includes eight squares identified as 1*s* to 8*s*. Each of these squares includes sales related successes and failures with commensurate rewards and penalties. Specifically, each square states as follows:

1*s*—Sales review committee. You landed a major account. Throw an "8", "7" or "6" to move one rung up the ladder and collect $10,000.00. 1 throw.

2*s*—*Sales review committee. You lost a major account. Throw a* "7" or a "Double" or be demoted and pay $10,000.00. 2 throws.

3*s*—Sales division manager's office. You have done a terrible job! Demotion. Pay $25,000.00.

4*s*—Sales review committee. You have done well. Throw a "4" or "10" for a promotion. 2 throws.

5*s*—Draw promotion/demotion card.

6*s*—Stock transfer specialist. Transfer two (2) certificates of stock to the player to your left. If you have no stock, pay $30,000.00.

7*s*—Stock transfer specialist. Player to your left transfers two (2) certificates of stock to you. If the player has no stock, the player pays you $30,000.00.

8*s*—Federal reserve specialist. Throw a "6" to receive $25,000.00. Throw an "8" and pay $25,000.00. Throw until you get a "6" or "8".

The stack of promotion and demotion cards 54 includes twenty-seven cards. Each of these cards reflects either instructions for a player to move up or down the corporate ladder in first path 12, and/or monetary compensation or penalties for work well or poorly performed. Specifically, each of cards 1 to 27 states as follows:

1. You are scheduled for a promotion seminar. depending on how well you do, may get you a a promotion. Throw a "6" or "8" and collect $15,000.00. 2 throws.
2. Your alertness and excellent communications skills prevented a costly system breakdown. If on the 4th corporate rung, move to the 5th rung or take another turn.
3. Take a demotion? Move down one rung or you have a chance. Throw a "7": no penalty. However, if you don't throw a "7", not only are you demoted, but you also pay $10,000.00. 2 throws.
4. The old sacred cow syndrome of . . . "We have never done it that way before" . . . will cost you. The player to your right experimented with the idea, had excellent results and will be promoted one rung and will collect $15,000.00
5. Your candid planning is now ready to pay off. If on the 1st rung, move to the 2nd rung; If not, throw a "7" and move up one rung and collect $10,000.00. 2 throws.

6. Due to your incompetence in your present position, you are demoted one rung where hopefully, you will be competent. Pay $10,000.00.
7. You out smarted one of the executives who is one rung ahead of you. As a bonus, each player one rung above you throws the dice. Player with the lowest score trades places with you and you collect $10,000.00. The looser pays $10,000.00. If no one is one rung above you, go to the bonus lane.
8. Take a demotion? You have a chance. Throw a "7": No penalty but throw a "Double" and you are demoted and pay $15,000.00. Throw until you get one of the two.
9. The audit committee has recommended to the organization to promote you for your outstanding system controls. However, your boss has second thoughts. In order to convince him, throw a "7". 2 throws.
10. You have been cited with an outdated operations procedure book for the second year in a row. You failed to focus your attendion on this problem. You are hereby demoted one rung and pay $15,000.00.
11. You helped solve a major problem. You had an idea the organization implemented. Congratulations, collect $20,000.00.
12. Good utilization of time management. Everything is under control in your department. You have time to see about a promotion. Throw an "8" or "Double" and collect $15,000.00. 2 throws.
13. It appears you have allowed someone to tamper with the system program. Throw an even number; no problem. Throw an odd number; skip your next promotion. 1 throw.
14. Your poor decision cost the organization a great loss in funds. You are demoted one rung. However, if you throw a "7" it is your lucky day with no demotion, but you skip a turn. 2 throws.
15. Good job! Your area of responsibility increased productivity by 25 percent this year and procedures were in order. Welcome to the next level of management. Collect $10,000.00.
16. You made a pass at your bosses' spouse at a company party and your boss knows. You have an opportunity to explain yourself. Throw a "7" or be demoted and pay $10,000.00. 2 throws.
17. Due to your poor communications, a serious system problem occurred—your error! If you are currently on the 5th rung, move down to the 4th rung or else skip a turn.
18. You have been playing golf when you should have been taking care of business. However, you are on a par five hole and if you can birdy (throw a "4") on this hole, no penalty. If you fail, you are demoted and pay $15,000.00. 2 throws.
19. Promotion? Demotion? You have a choice. You may throw or give the dice to any player of your choice. Whoever throws must get a "6" or "8" and receive a promotion or otherwise be demoted. 2 throws.
20. The key individuals in your area are transferring out. Because of your incompetence, take a step down the ladder and train new employees. Pay $10,000.00.
21. Your accounting balancing skills are finally paying off. Because all your accounts are in order, take a promotion. Collect $10,000.00 as a bonus.
22. Good news? Your Uncle T. D. who was Jr. Executive was just promoted to Sr. Executive. Therefore, we have a promotional position for you. Move up one rung and do thank your Uncle T. D. Collect $10,000.00.
23. Your area of responsibility is out of order. You have seriously failed your audit. Take one demotion or pay $50,000.00.
24. The organization has restructured. You may be the one they are looking for to head a new area if you can. Throw a "6" or "8" for a promotion and collect $25,000.00. 2 throws.
25. Poor use of time management. You allowed too many interruptions. Take your work home. Throw a "7" or be demoted and pay $10,000.00. 2 throws.
26. Your poor planning is visible now! If on the 2nd rung, move down to the 1st rung; otherwise throw a "7" or be demoted and pay $10,000.00 2 throws.
27. Good news? A new department has been formed and you are chosen to head the operation due to your expertise. Congratulations! You are promoted! Collect $15,000.00.

The stack of audit review cards 58 includes nineteen cards. Each of these cards reflects the results of a good or bad audit or audit related functions with appropriate rewards and penalties. Specifically, each of the cards states as follows:

1. When audit speaks, everyone listens! The organization heard of your outstanding results. As a reward, throw a "Double" and go to the bonus lane. Throw a "7" and collect $15,000.00. 2 throws.
2. Poor utilization of human resources. Loose a turn while you reorganize.
3. Audit found something in the system that could be positive or negative. Your answer to their question could mean a bonus or a fine. Throw an odd number and collect $10,000.00 or throw an even number and pay $10,000.00. 1 throw.
4. You have your choice of going to the bonus lane or throw for $50,000.00. You have two throws to get a "4" or "10" and collect $50,000.00. 2 throws.
5. Audit recommends you be awarded $15,000.00 to purchase a formal training package for more effective procedure control.
6. Possible safety hazard! Pay $15,000.00 for safety equipment.
7. Audit recommends you be awarded $5,000.00 so you may fly to a two-week "New System Convention".
8. Your accounts are seriously out of balance and have been for sometime. You have one chance to balance the accounts or pay $15,000.00. Throw an even number for no penalty. 1 throw.
9. Client confidentiality violated? Client called and was very upset and wants your job! Throw an odd number and it will be just a misunderstanding but throw an even number and skip a turn while you apologize.
10. No audit exceptions this year! Bonus time! Collect $15,000.00.
11. Audit recommends a tighter security system (situation beyond your control); collect $5,000.00 to purchase an alarm system.
12. Good listening skills is essential for effective management! "You were not paying attention" and it is going to cost you $10,000.00 to fix the problem. Next time, listen to your employees!
13. During an initial audit of your area, it was discovered that, due to increased volume, it is impossible to get the daily job completed. Collect $10,000.00 to replace some faulty equipment.

14. One chance to explain the two month's extreme overtime salary account. If you throw an even number there is no problem but if you throw an odd number skip a turn. 1 throw.
15. You are "Tops" in audit's eyes! Your area audit was the best in the organization, or so it seems. Go to the nearest promotion/demotion square and see if you can prove yourself.
16. Your priorities are not in order. Pay $15,000.00 for a private consultant to help you with your problem(s).
17. You implemented a new system that may or may not be fool proof. The system is fool proof if you throw an odd number and you collect $15,000.00. 1 throw.
18. You organized the blunder the previous manager left you. As a company bonus, collect $25,000.00
19. Your accounting program is obsolete. Pay $15,000.00 for a new one. Audit has spoken!

The stack of decision evaluation cards 62 reflects in each of twenty-four cards the good or bad decisions made. The rewards or penalties associated with each decision are stipulated. Specifically, the decision evaluation cards reflect various decisions, as follows:

1. Your last throw was a bad decision. Pay $10,000.00.
2. Give the dice to the second player to your left and the player has one throw to throw an even number to have you go to the bonus square. If he throws an odd number, you skip a turn.
3. Lack of sleep take a real "Pound of Flesh". The decision you made on a new operation system was not clear. Pay $15,000.00 for professional help.
4. Due to utilization of effective follow up action on a problem. You were able to prevent serious consequences. As a reward and a company incentive, collect $20,000.00.
5. Another good decision! Collect $15,000.00.
6. Give the dice to any player you choose. If the player throws an even number give the player two certificates of stock. If the player throws an odd number, the player gives you two certificates of stock. If stock cannot be transfered, losing player pays $30,000.00.
7. You have an opportunity to win $15,000.00. Give the dice to any player. If the player throws a "Double" or a "7", you win! 2 throws.
8. You have the choice to move or delegate to any player to move to the nearest audit review square to the left.
9. Your decision! Throw again or draw another decision evaluation card. If you decide to throw again, and you throw a "Double", go to the bonus square. 1 throw.
10. You hired a "top knotch trouble shooter" to help you out. Give the dice to any player you choose. If the player throws an even number, you collect $10,000.00 but if the player throws an odd number, you pay $10,000.00 to the player.
11. Another bad decision! Pay $10,000.00
12. Bad decision! You upset your department personnel. You are hereby suspended for one day, pending an investigation. Loose a turn!
13. You placed an incompetent individual in a key position; pay $15,000.00 to fix the machine used.
14. Give the dice to any player. That player has two throws to get a "7" or a "double" which will mean $10,000.00 for you. If no "7" or "double" is thrown, player pays controller $10,000.00.
15. Throw again? However, decide whether to move forward or backward prior to your throw. If you throw a "double" you go to the nearest stock option square, if you choose.
16. You are in charge while the boss is on vacation. You have a choice. Collect $15,000.00 or throw an even number and collect $30,000.00 but if you throw an odd number collect nothing.
17. Decisions! Decisions! Decisions! Either (1) move to the nearest promotion/demotion square; (2) take another throw; or (3) trade with any player, and both follow the instructions of the square to which they have moved.
18. Excellent decision! On this throw, collect $10,000.00!
19. You decided to go home early to watch a football game when there was a system problem. Pay $15,000.00 as a penalty.
20. In order to establish/improve performance and job standards in your department, you decided to send your key staff to a private seminar. Pay $5,000.00 for each employee (the number of players).
21. Fatal mistake! You transferred at the wrong time. Your ex-boss just quit the organization and a promotion position is open. The players to your right and left have one throw each for that promotion, the player throwing the highest number wins and collects $10,000.00.
22. As a bonus for improving productivity through the use of a key managerial concept of "improving employee performance by improving work habits", collect a bonus of $10,000.00.
23. All play and no work—at the golf course—resulted in operational neglegence. Skip a turn while you reorganize.
24. Delegate to the player to your left and have that player go to the nearest audit review square to the left.

It may be noted that the promotion and demotion cards, audit review cards and operations cards also include various cards wherein a player may exercise certain gambling instincts to modify the risk/reward ratio.

Referring specifically to FIG. 1, bonus lane 36 includes twelve spaces, each of which spaces depicts a monetary sum. The space upon which a player lands in the bonus lane reflects the amount of cash to be paid to him.

To play the game, each player in turn places one of his playing pieces 76, 78 in area 80 designated—START—. The other of the player's playing pieces is placed upon first path 12 in the area designated mail clerk 14. To begin, a player rolls pair of dice 82, 84; the total number showing is the number of spaces along bonus lane 36 which the player moves his piece. The monetary amount at the space upon which he comes to rest is paid to him. Thereafter, the player relocates his playing piece upon square 1*c* and throws the dice again to begin to move through the various sections along the second path. At each space upon which he comes to rest, the player follows the instructions attendant the space. This process is repeated by each player in turn.

The play, aside from being controlled by the various instructions on each of the spaces upon which a player may land and the various cards in the three sets of cards, is also subject to a number of general rules controlling the play. The more salient of these rules are recited below under their appropriate catagorizations.

Starting. Each player throws the dice once and the player with the lowest sum begins. In the event of a tie, the tieing players throw the dice again. The instructions contained in compensation section 40 are disregarded by each player until each player has completed a first circuit of second path 34.

Move back plays. If a player lands on another player's square, the previous player moves back two squares and follows the instructions attendant the square to which he moves, including any instructions in squares 9*c* or 8*c* even though he may not have made a complete circuit of second path 34.

Throwing doubles. When a double is thrown the player throws again and continues to throw until two different numbers are thrown; the total number of spaces moved is the sum of the doubles thrown plus the highest number in the last throw.

Promotion and demotion cards. If a player is demoted and if he is already at the lowest rung, mail clerk 14, only instructions attendant the throwing of the dice to determine whether a penalty is to be levied is followed.

Skip a turn square. If a player lands on one of these square as a result of a double throw, the player may forfeit the bonus throw and continue play on his next turn.

Odd or even throws. If a player throws a double on an even throw, the amount to be collected is doubled.

Trading an evaluation square. A player has the option of trading with any other player of his choice. The player with whom the trade is made then moves to the trading and evaluation square and has the option of trading with any player other than the original player landing thereon. Trading continues unless any player, including the first, elects to take the option of throwing the dice for the possibility of earning $30,000.00.

Special bonus lane. A player who lands on square 1*c*, wherefrom he moves into bonus lane 36 upon a second throw of the dice immediately thereafter returns his playing piece to square 1*c*.

Budget control square. If, as a result of a double on the dice a player lands on this square, he receives an extra throw in an attempt to get an "8". On his next regular turn, a player has two throws to try for an "8"; if one of these throws is a double he receives a further free throw or until a double is not thrown or an "8" is thrown.

Stocks. A player is limited to five certificates of stock each time a player lands on a stock option square. When all certificates of stock have been sold without anyone winning the game, an inflationary period is declared and all penalties are doubled but any monetary rewards granted remain the same. The inflationary period continues until five certificates of stock have been returned to the depository. A player may sell certificates of stock to the bank for face value or to another player for whatever price he can negotiate. Only those players owning less than forty-six percent (46%) of stock are elegible to bid for another player's stock and only if success in such bidding would not increase their percentage ownership above forty-six percent (46%).

Loan option. Any player is elegible for a loan in the amount of $50,000.00 if the player owns no stock nor has any money. Application may be made for a total of two loans. If a third loan is required, the player must declare bankruptcy and is out of the game for poor management of funds. Each time a loan is granted, the player must place a token 77 with the bank as a pay back symbol. No player having a token placed with the bank can win even though such a player may have been promoted to chairman of the board. Should the latter occur, the player must continue to play in an effort to collect sufficient funds to pay off the debt.

Playing pieces. Each player has two playing pieces 76, 78, one of which moves along first path 12 and the other of which moves along second path 34.

Combining forces. In the event a player has been promoted to president, rung 30, the two players lowest on the ladder may combine forces by cumulating their position on the corporate ladder and having one of the players drop out of the game. However, the highest position either of the two players may be is that of assistant vice-president, rung 24 and the cumulated position must be president, rung 30, or less. On combining of the two player's stock, any excess over forty-six percent (46%) is returned to the depository. The funds of each of the two players is combined, regardless of the aggregate amount.

Controller. A player is designated as controller to control the flow of cash and certificates of stock. He also distributes to each player at the beginning of the game four $5,000.00 bills and four $10,000.00 bills for a total of $60,000.00.

Stock certificates. Each stock certificate has a face value of $20,000.00 and represents two shares.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A game simulative of the vagaries of success within a corporation, said game comprising in combination:

(a) a game board having a first path and a second path;

(b) a plurality of playing pieces for each player, one of said playing pieces being used in conjunction with said first path and another of said playing pieces being used in conjunction with said second path;

(c) means for arbitrarily determining the number of squares each player in turn moves his playing piece along said second path;

(d) said first path including a number of levels having an ascending order of signficance relative to positions within the corporation;

(e) said second path being a continuous path segmented into a plurality of squares, said second path including a plurality of discrete sections, each said section embracing a number of squares and being representative of a work function within a corporation;

(f) a third path distinct from said second path with entry into said third path being determined by a designated one of the squares of said second path and having a terminal end remote from said second path, said third path having a plurality of further squares equal in number to the highest number available from said determining means, each further square being reflective of a quantity of said medium of exchange or said certificates of stock to be delivered to a player;

(g) each square of each said section including a certain directive pertinent to movement of the respective one of a player's playing piece along one of said first and said second path;

(h) a plurality of stacks of cards, each said stack of cards being related to employee evaluation criteria;

(i) one of the squares in at least some of said sections including a directive referencing one of said stacks of cards and subjecting a player to the directive of a card in the referenced one of said stack cards;

(j) a medium of exchange for reflecting each player's financial status which status may be altered in response to directives of the squares and said cards; and (k) a plurality of certificates of stock for determining each player's degree of ownership in the corporation which degree of ownership may be altered in response to directives of the squares and said cards.

2. The game as set forth in claim 1 wherein said plurality of sections comprise six sections.

3. The game as set forth in claim 2 wherein each of said six sections includes one square referencing one of said stacks of cards.

4. The game as set forth in claim 3 wherein said stacks of cards comprises three stacks of cards.

5. The game as set forth in claim 2 wherein each of said six sections includes at least eight squares.

6. The game as set forth in claim 1 wherein each section of said sections is designated by one of the terms compensation, production, operations, investments, marketing and sales and wherein said designated square comprises a square in said compensation section.

7. The game as set forth in claim 1 wherein said third path extends from said designated square and terminates remote from said second path.

* * * * *